United States Patent [19]

Manners et al.

[11] 4,094,941

[45] June 13, 1978

[54] METHOD AND APPARATUS FOR MAKING DECORATIVE PANELS IN RELIEF

[75] Inventors: Stanley H. Manners; Gerhard Borbonus, both of Boise, Id.

[73] Assignee: Stanley H. Manners, Boise, Id. ; a part interest

[21] Appl. No.: 682,893

[22] Filed: May 3, 1976

[51] Int. Cl.[2] ..... B28B 1/08; B28B 1/16

[52] U.S. Cl. ..... 264/71; 264/256; 264/333; 264/DIG. 57; 425/421; 425/811

[58] Field of Search ..... 264/34, 71, 245, 251, 264/256, 333, DIG. 57; 425/421, DIG. 811; 249/15, 16; 427/272

[56] References Cited

U.S. PATENT DOCUMENTS

| | | | |
|---|---|---|---|
| 978,617 | 12/1910 | Mitats | 264/DIG. 57 |
| 1,921,100 | 8/1933 | Schnurer | 264/251 |
| 2,058,167 | 10/1936 | McQuade | 264/DIG. 57 |
| 2,616,145 | 11/1952 | Dufford | 264/34 X |
| 2,819,495 | 1/1958 | Krause | 264/256 X |
| 2,965,948 | 12/1960 | Reckman | 425/421 X |
| 3,712,825 | 1/1973 | Yocum | 425/811 X |

*Primary Examiner*—Thomas P. Pavelko
*Attorney, Agent, or Firm*—Clarence A. O'Brien; Harvey B. Jacobson

[57] ABSTRACT

A structure defining an upwardly opening tray is provided and initially filled with a hardenable mixture compactable to at least a reasonable degree and a grid is thereafter introduced into the tray and depressed downwardly into the hardenable mixture to a level spaced above the bottom of the tray and with upper portions of the grid projecting above the mixture. A second hardenable mixture is thereafter introduced into the tray within the openings formed by the grid and on top of the first mixture to a level substantially flush with the upper surfaces of the grid. A male die including coplanar spaced die members snugly receivable within the voids or spaces defined by the grid is positioned with the spaced die members in registry with the openings or spaces defined by the grid and forced into the spaces or openings so as to compress both mixtures within the tray. The step of compression is continued and the entire assembly including the tray, the grid and the male die are vibrated to compact the mixtures within the tray after which the grid and male die are coupled together for simultaneous extraction and the same are extracted from the tray and the mixtures therein during continued virbration of the tray to assist in separation of the grid and the male die members from the hardenable mixtures within the tray. Subsequently, vibration of the tray is terminated and the mixtures are allowed to fully harden resulting in the formation of a substantially rigid sheet-like panel representing the face surfaces of a mortar and brick construction.

6 Claims, 9 Drawing Figures

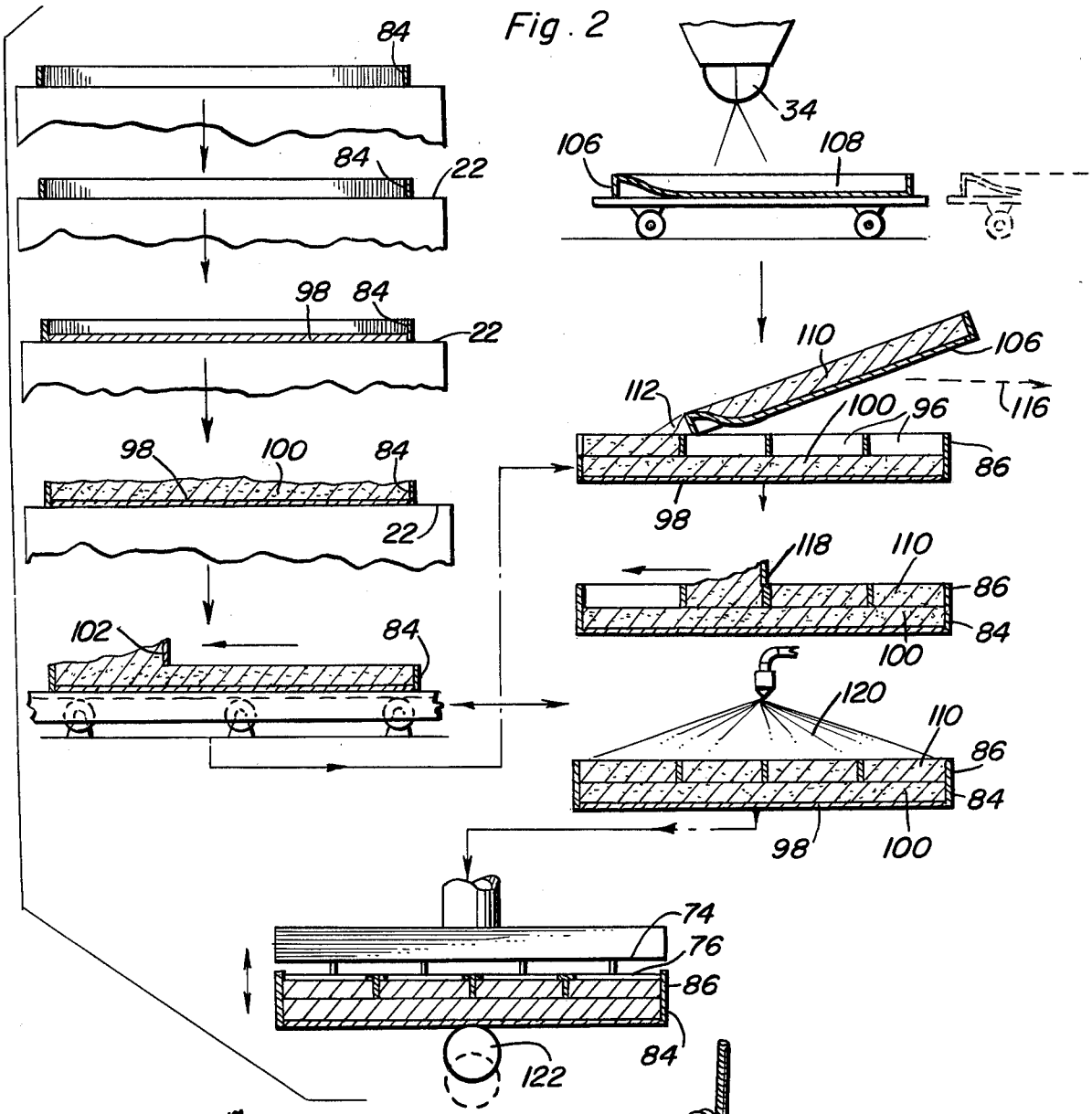
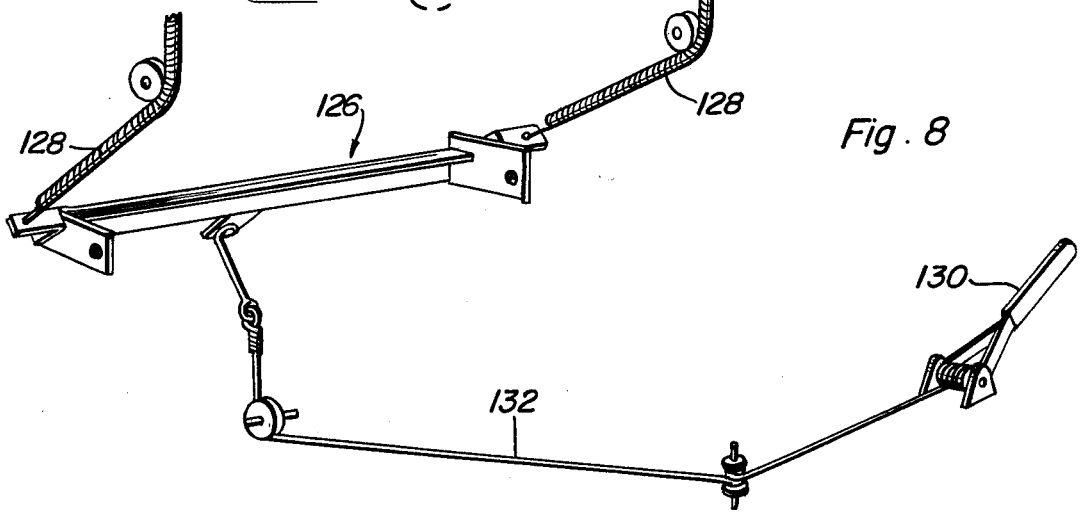
Fig. 8

METHOD AND APPARATUS FOR MAKING DECORATIVE PANELS IN RELIEF

BACKGROUND OF THE INVENTION

Heretofore various constructions have been designed for molding panel-like cemetitious bodies of hardenable materials. However, these constructions have for various reasons not been capable of properly compacting the cementitious materials utilized in the construction of the panels, or have not been capable of constructing panels in relief including different areas thereof having different colors. Examples of previously patented constructions utilizing some of the basic features of the instant invention are disclosed in U.S. Pat. Nos. 2,708,783, 2,835,016, 3,277,551, 3,400,179, 3,426,112, 3,606,633 and 3,764,242.

BRIEF DESCRIPTION OF THE INVENTION

The method and apparatus of the instant invention are utilized to form a building panel such as a wall panel or floor panel having a relief pattern simulating a brick and mortar surface or other similar surface. In addition, the method and apparatus may be utilized to form panels having various patterns embossed or in relief thereon.

One important aspect of the method and apparatus resides in the fact that areas of different elevation of the panel in relief being formed may be of different colors and of even different materials, according to the desired end aesthetic appearance.

It is accordingly the main object of this invention to provide a method and apparatus by which various forms of building panels in relief may be constructed.

Another object of this invention is to provide a method and apparatus for constructing building panels which may closely simulate brick and mortar wall or floor panels as well as other similar types of masonry surfaces.

Yet another object of this invention is to provide a method and apparatus whereby building panels and the like may be formed in an efficient, inexpensive and effective manner.

Another object of this invention is to provide a method and apparatus for forming building panels which may be utilized by means of relatively simple constructions in order to produce low volume quantities of panels and yet which may be expanded into more complex and even automated manufacturing systems for production at much higher volume.

A final object of this invention to be specifically enumerated herein is to provide an apparatus for constructing building panels in relief and which will conform to conventional forms of manufacture, be of simple construction and easy to use so as to provide a device that will be economically feasible, long lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a schematic view illustrating the various procedural steps followed in construction of building panels in relief in accordance with the present invention;

FIG. 8 is a fragmentary perspective view illustrating one of the control assemblies by which the mold and grid components illustrated in FIG. 7 are retained in proper registered position and against shifting relative to each other during the final vibration step of the method of forming the building panel in relief.

DETAILED DESCRIPTION OF THE INVENTION

Figure 1:
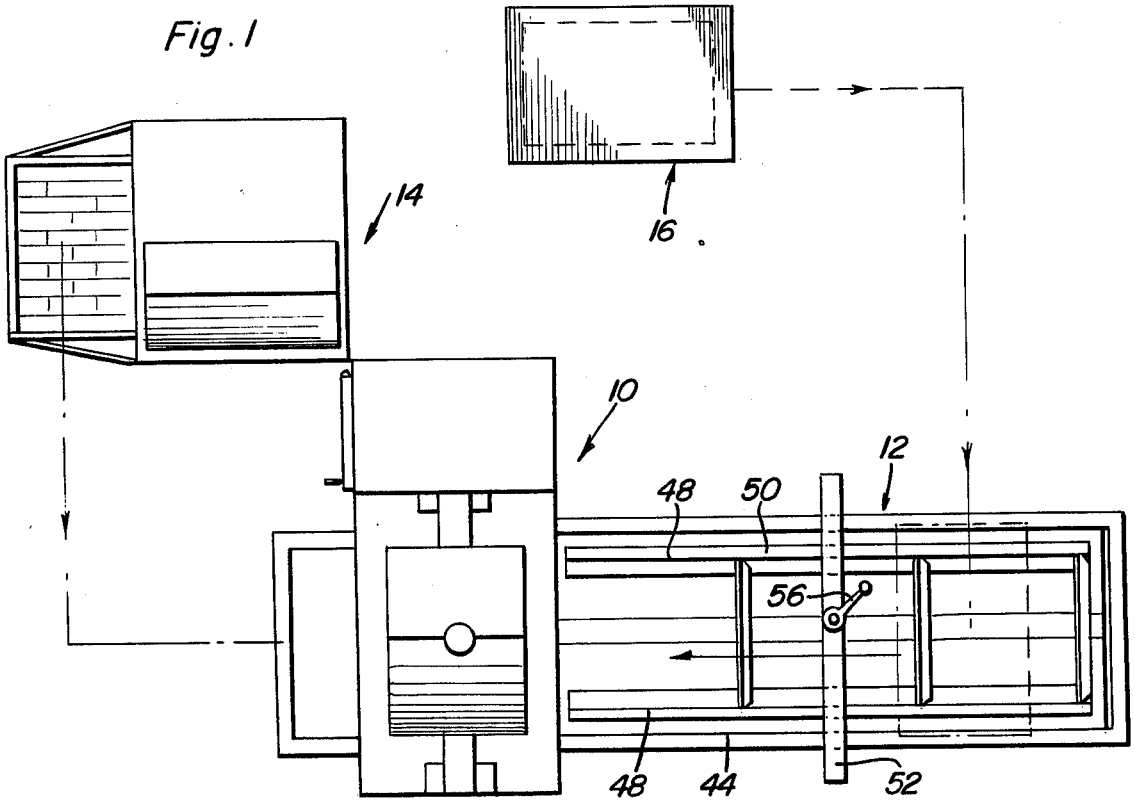
FIG. 1 is a schematic plan view illustrating the various stations of the apparatus of the instant invention and the succession of operation of the various stations in producing panels in relief.
Figure 9:
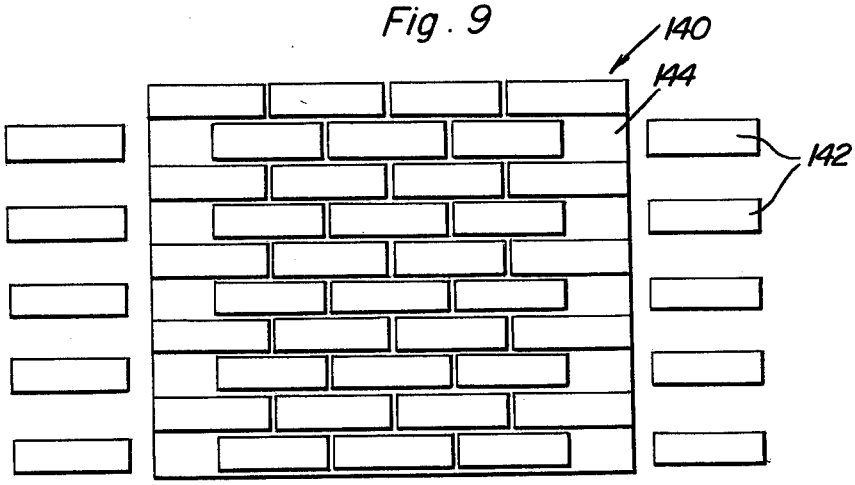
FIG. 9 is a plan view of a completed building panel in relief constructed in accordance with the present invention and with relief joining members for use between adjacent panel edges being illustrated in exploded position.

Referring now more specifically to the drawings the numeral 10 generally designates a first station structure, the numeral 12 generally designates a second station structure, the numeral 14 generally designates a third station structure and the numeral 16 generally designates the fourth station structure of the instant invention, see FIG. 1.

Figure 6:
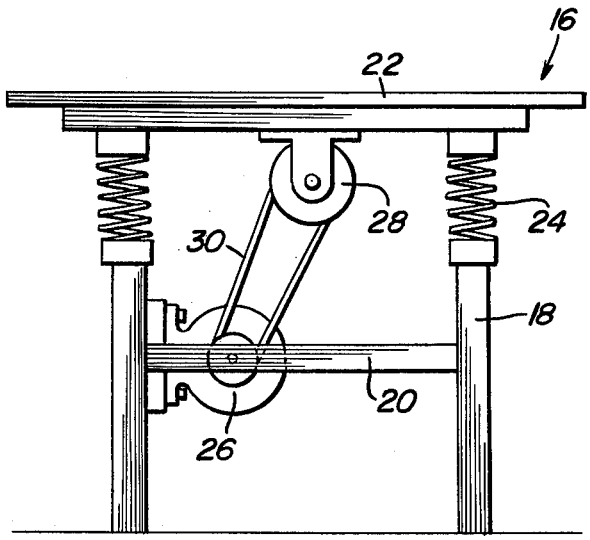
FIG. 6 is a side elevational view of a fourth station structure which is utilized initially in the construction of a building panel in relief.

Referring now more specifically to FIG. 6, the fourth station structure 16 includes four upstanding legs arranged at the corner portions of a rectangular plan area and the legs 18 are suitably interconnected by means of horizontal longitudinal braces 20 as well as corresponding horizontal transverse braces (not shown). The four corner portions of a generally rectangular support table 22 are supported from the upper ends of the legs 18 by means of coil springs 24 and an electric motor 26 driving an eccentrically weighted rotary assembly 28 journalled from the underside of the support table 22 by means of an endless flexible belt 30 is supported from the lower portion of the structure 16 defined by the legs 18 and horizontal braces. Accordingly, upon operation of the motor 26 the eccentrically weighted rotary assembly 28 imparts a vibration to the support table 22.

Figure 5:
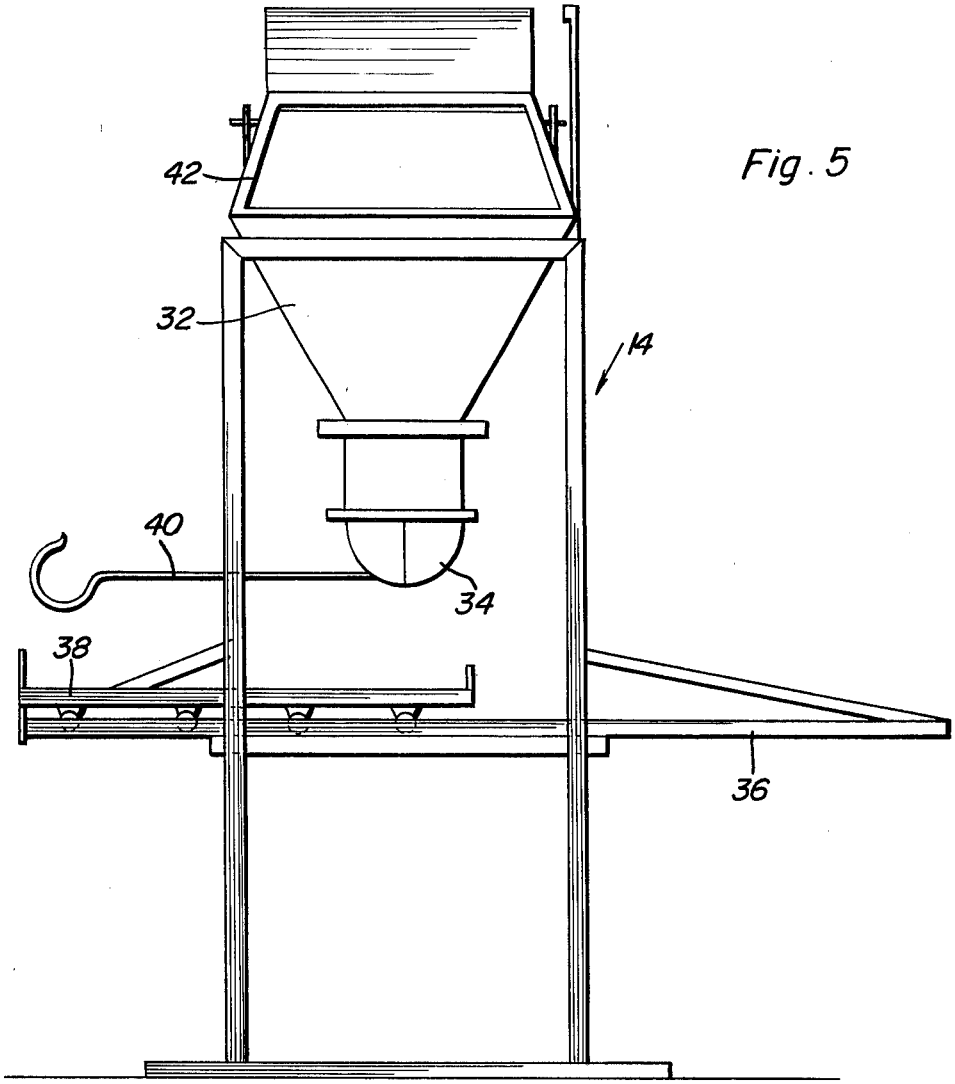
FIG. 5 is a side elevational view of a third station structure utilized to perform an intermediate step in the construction of a building panel in relief.

Referring now more specifically to FIG. 5 the third station structure 14 includes an elevated hopper 32 including a lower discharge outlet 34 poised above a horizontal track assembly 36 having a wheeled support structure 38 rollingly supported thereon. The discharge outlet 34 of the hopper 32 includes a control member for controlling the discharge of fluent material from the hopper 32 through the outlet 34 and the upper portion of the hopper 32 includes inlet structure 42 by which fluent materials or mixtures may be admitted into the hopper 32 for subsequent discharge therefrom through the outlet 34.

Figure 4:
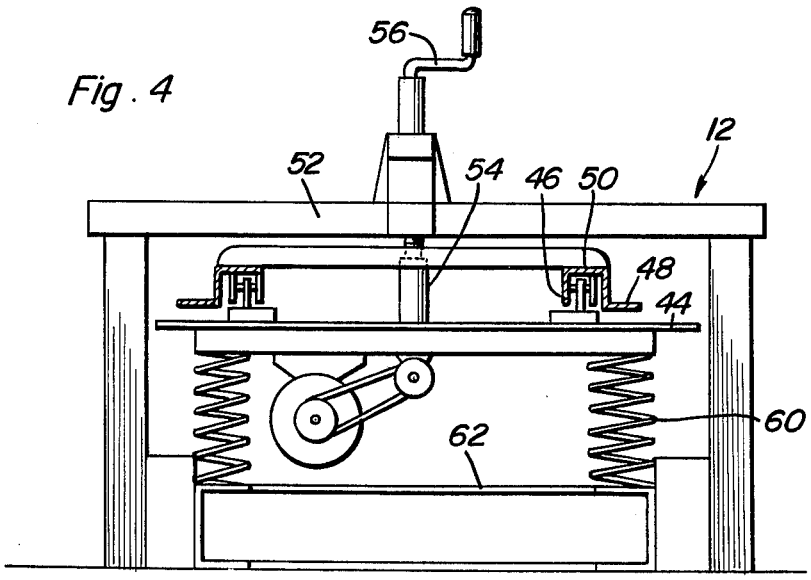
FIG. 4 is an end elevational view of another station structure utilized just prior to operation of the structure illustrated in FIG. 3 and which includes structural features for transferring partially completed work from the station structure of FIG. 4 to the station structure of FIG. 3.

With attention now invited more specifically to FIG. 4 of the drawings as well as FIG. 1 it may be seen that the second station structure 12 comprises an elongated spring supported table top or support table 44 upon which a pair of roller tracks 46 are supported, the roller tracks 46 in turn slidingly supporting opposite side parallel members 48 of a support frame 50, the frame 50 being shiftable longitudinally of the tracks 46 for shifting of the end of the frame 50 adjacent the station structure 10 toward and away from the latter. Further, the station structure 12 includes a stationary overhead portion 52 from which a screw jack mechanism 54 is supported operable by means of a crank 56 journalled from the overhead portion 52. The screw jack structure 54 is operatively connected to the support table 44 whereby the latter and the support frame 50 supported therefrom may be depressed by compression of the coil springs 60 which support the table 44 from the base 62 of the station structure 12.

Figure 7:
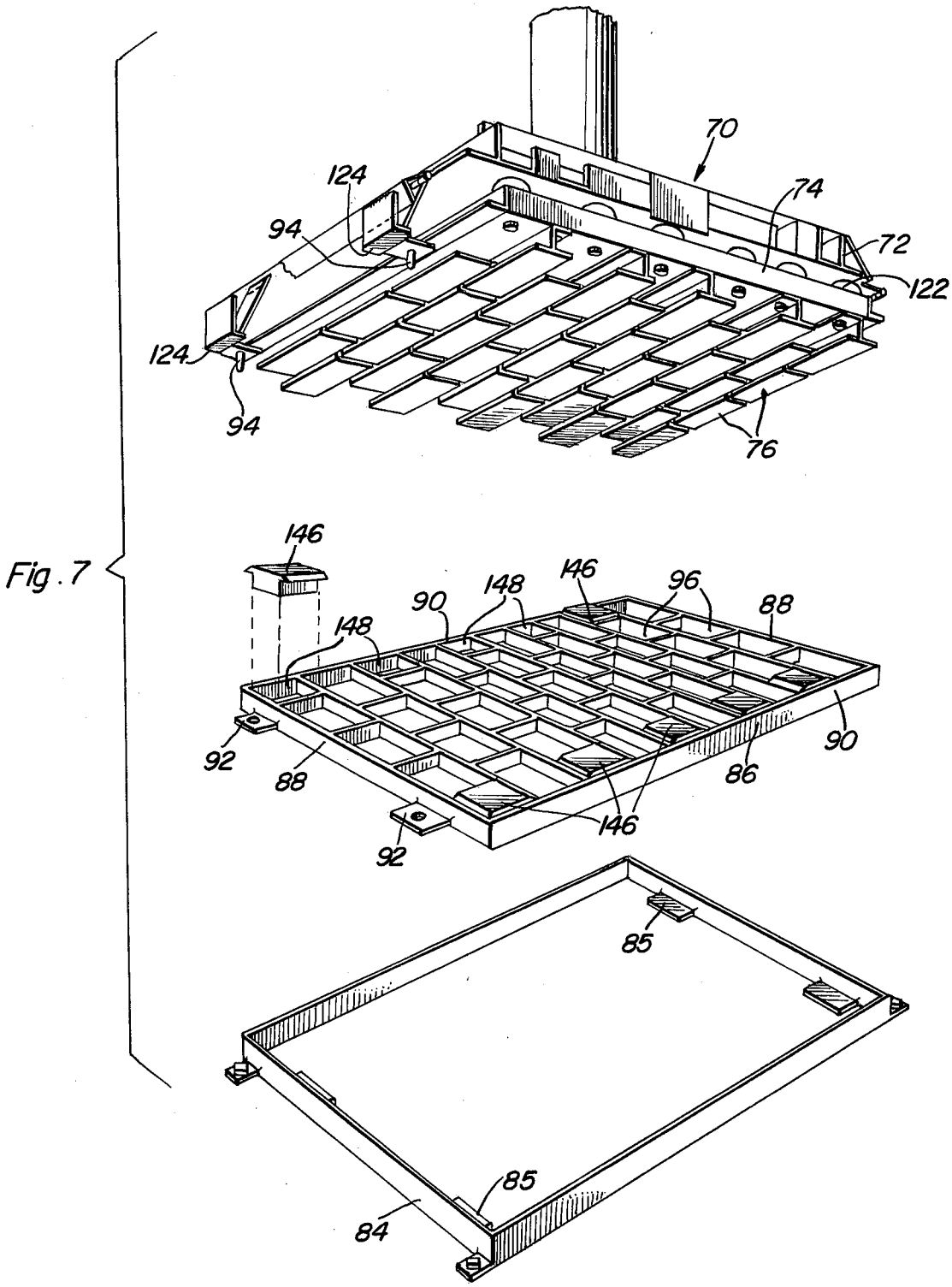
FIG. 7 is an exploded perspective view of co-acting mold, grid and male die components of the station structure illustrated in FIG. 3.

Referring now more specifically to FIGS. 1 and 7, the first station structure 10 includes an overhead support 64 from which a double acting hydraulic cylinder 66 is supported. The cylinder 66 is disposed in upstanding position and includes a lower end extendable and retractable piston rod portion 68 extendable downwardly and retractable upwardly relative to the overhead structure 64. A head assembly referred to in general by the reference numeral 70 is supported from the lower end of the piston rod portion 68 and includes a base rigid with the piston rod portion 68 and a male die structure 74 spring supported from the base 72 and including a plurality of relatively rigidly supported spaced male die members 76 each having the configuration of the face of a brick.

The station structure 10 further includes an upstanding support 78 disposed beneath the head assembly 70 and spring supporting, by means of coil springs 76, a support table 80. The support table 80 includes spring set and mounted stabilizing brackets 82 beneath which a rectangular base mix tray frame 84 including inwardly projecting support flanges 85 is removably supported. Further, a female grid-type die 86 is provided and is positionable on the tray frame in predetermined position thereon by use of center-match grooving (not shown) on the bottom side of all four longitudinal and transverse members 88 and 90 of the female die 86. In addition, the female die includes longitudinally spaced opposite side apertured and outwardly projecting flanges 92.

The head assembly 70 includes depending locating pins 94 which are receivable downwardly through the apertured flanges 94 for correct registry of the male die members 76 with the numerous spaces 96 defined by the female die 86.

Referring now more specifically to FIGS. 1, 2 and 7 of the drawings the tray frame 84 is placed upon the support table 22 and a suitable "back" mix board 98 is placed within the frame 84. Thereafter, a somewhat fluent and hardenable "back" mix 100 is placed within the frame 84 on top of the board 98 level with the top of the frame 84. The motor 26 is actuated during the filling process and the levelling process which may be carried out by a screed 102 and thereafter the motor 26 is deactivated and the frame 84 with its contents including the board 98 and the mix 106 is transported manually (although this step may be automated and mechanically carried out) to the support frame 50 whereupon the latter is advanced toward the station structure 10 in order to position the frame 84 and its contents over the support table 80. Thereafter, the crank 56 of the screw jack 54 is actuated to depress the support table 44 of the station structure 12 resulting in the frame 50 being lowered whereby the tray frame supported thereon will be also lowered into position on the support table 80 and may be shifted securely under the brackets 82 in proper position on the support table 80. Subsequently, the lowered frame 50 is retracted back away from the station structure 10 to its original position.

The female die 86 is thereafter lowered into position on the tray frame 84.

With attention now invited more specifically to FIGS. 1, 2 and 5 of the drawings a "face" mix tray 106 provided with longitudinally extending and transversely spaced partitions 108 is positioned on the support structure 38 with the latter disposed at the right hand end of the track assembly 36 as viewed in FIG. 5. Then, the support structure 38 is advanced to the left while the control member 40 is actuated to cause a dry "face" mix from within the hopper 32 to be discharged therefrom through the outlet 34 down into the tray 106 in a manner evenly distributing the dry mix within the partitioned tray 106. Thereafter, the tray 106 is transported manually (although this step could be carried out by automated structure) to the station structure 10 and tilted so as to pour the dry mix 110 therefrom as at 112, see FIG. 2, into the spaces 96 of the female die 86 in a manner evenly filling the spaces 96. If it is desired, a scraper (not shown) may be pulled through the face mix tray 106 in order to evenly discharge the face mix 110 therefrom as the tray 106 is pulled across the female die 86 in the direction of the arrow 116, see FIG. 2. Thereafter, a screeder 118 may be pulled across the upper edges of the female die 86 and the leveled face mix is dampened by a spray 120 of water. The male die structure 74 is then lowered into position with the die member 76 snugly received downwardly into the upper portions of the spaces 96 of the female die 86 in order to compress the damp face mix (and thus the back mix). Thereafter, a motor driven vibrator assembly 122 is actuated. Inasmuch as the male die members 76 are spring mounted they continue downwardly, slightly, into the spaces 96 and the mixes 100 and 110 are compressed and compacted while being vibrated. This action, over a period of time of less than one minute, causes formation of the desired relief of the product to be produced, enables the release of the die structures 74 and 86 from the product and the dryer under portion of the face mix 110 to absorb sufficient water and chemicals from the back mix 100 to form the proper degree of uniformity of wetness to form and cohere the product. Also, the pressure and vibration causes the interface portions of the mixes or mix layer materials 100 and 110 to intermix.

During and near the end of the vibrating process two pairs of opposite side pivotally supported outrigger dogs 124 supported from the base 72 of the head assembly 70 are swung downwardly into engagement with the flanges 92 and held in position by any convenient manner such as by C clamps (not shown).

A clamp assembly 126 is pivotally supported from the support table along the side thereof opposing station 12, spring biased to an inwardly displaced clamping position by means of expansion springs 128 and retractable under the influence of a control lever 130 operatively connected to the clamp assemblies 126 by means of guided flexible cables 132. The clamp assembly 126 is allowed to swing into clamping position over the female die 86 to secure the latter on top of the tray frame 84 after the head assembly 70 is lowered and at substantially the same time the assembly 122 is actuated to initiate vibration of the table 80.

Figure 3:
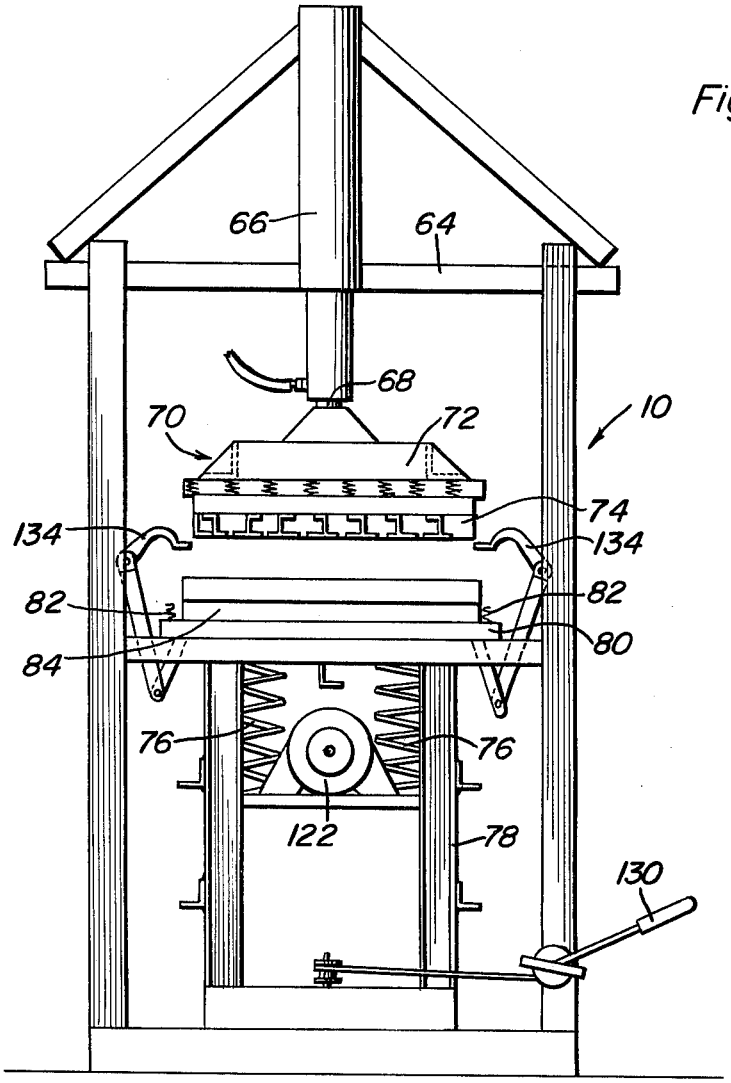
FIG. 3 is a side elevational view of the main press and vibrating structure utilized to perform the latter steps in constructing a panel in relief.

Nearing the end of the vibration process opposite side dogs or clamps 134 supported from the table 80 see FIG. 3, are placed over the base 72 on opposite sides thereof and as the pressure of the cylinder 66 is released and the piston rod portion 68 is retracted upwardly while the assembly 122 is still in operation, the upper portion of the base 72 connects or abuts with the clamp assemblies 134 and causes the support table 80 to be pulled upwardly in order to elevate the board 98 through the frame 84. Of course, while the piston rod 68 is being upwardly displaced the male die structure 74 and the female die, by means of the dogs 124, will be raised relative to the frame 84 while the assembly 122 is still in operation. After separation of the female die 86 and the male die structure 74 from the mix the operation of the assembly 122 may be terminated and the board 98 having the finished product 140 thereon simulating the face surfaces of a brick and motor panel may be removed from the first station structure 10.

The spraying of water as at 120 on the face mix 110 insures that sufficient dampness will be provided to allow ease in separation of the male die members 76 from the face mix 110 and the finished product in the form of the panel 140 may be allowed to dry. Of course, connecting relief blocks 142 (separately formed) may be utilized to join adjacent panels 140 between the marginal areas 144 thereof which do not have face mix 110 thereon, which marginal areas 144 of the panel are defined by inserts 146 disposed in abbreviated spaces 148 formed in the female die 86.

The "back" mix may consist basically of a cementitious binder and aggregate wherein the aggregate is a mixture of sawdust, wood chips, fiberglass roving (chopped) and horticulture grade perlite and the binder is any mixture of conventional materials which will set to a hard product upon admixture of water. For example, hydraulic, aluminous or Portland cements are all useful and consist essentially of alumina, lime and silica in various combinations and proportions. It is particularly desirable to include in the binder other additives which confer flexibility and cohesiveness to the final product. The "face" mix may be of a similar nature except that it will be essentially dry and will include a mixture of fine and starch grade perlite instead of horticulture grade perlite and will further include fine saw dust as opposed to coarse sawdust and wood chips. Further, the "face" mix will have coloring added as desired, whereby the finished product will more closely resemble a brick and mortar wall surface.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. The method of forming a multi-ply building panel including a back ply and a face ply and with the face ply defining a relief pattern, said method including:

(a) placing a first hardenable fluent mix layer material in an upwardly opening shallow receptacle;

(b) supporting a grid in position over the first layer with the grid including intersecting members defining said pattern and the lower marginal portions of said intersecting members at least slightly downwardly depressed into said first layer while the latter is still fluent;

(c) placing a second hardenable fluent mix layer material, of an appearance when hardened different than the appearance of the first mix material when hardened, on top of the first mix layer within the voids of the grid defined and bound by adjacent intersecting members of the grid;

(d) vibrating and compressing said first and second layers thus causing the interface portions of the mix layer materials within the voids to intermix; and (e) allowing said mix layers to at least slightly harden.

2. The method of claim 1 wherein (d) includes:

(1) vibrating said receptacle and grid together.

3. The method of claim 2 wherein (d) includes:

(A) simultaneously registering and advancing male die members with and into said voids from the sides thereof remote from said first mix layer and (1) includes vibrating the male die members with said receptacle and grid.

4. The method of claim 3 wherein (e) includes:

(2) withdrawing said male die members and grid, as a unit, from said mix layers during (1).

5. The method of claim 2 wherein (d) includes:

(A) simultaneously registering and advancing male die members with and into said voids from the sides thereof remote from said first mix layer, in order to compress the mix layers between said receptacle and die members.

6. The method of claim 5 wherein (2) includes spraying the face layer with water prior to (A).

* * * * *